US008105210B2

(12) United States Patent
Seybold

(10) Patent No.: US 8,105,210 B2
(45) Date of Patent: Jan. 31, 2012

(54) JAW RELAXATION EXERCISE APPLIANCE

(76) Inventor: Harvey G. Seybold, Hinsdale, IL (US)

( * ) Notice: Subject to any disclaimer, the term of this patent is extended or adjusted under 35 U.S.C. 154(b) by 263 days.

(21) Appl. No.: 12/074,647

(22) Filed: Mar. 5, 2008

(65) Prior Publication Data

US 2009/0017992 A1 Jan. 15, 2009

Related U.S. Application Data

(60) Provisional application No. 60/933,729, filed on Jun. 8, 2007.

(51) Int. Cl.
*A63B 21/00* (2006.01)

(52) U.S. Cl. ..... 482/11; 433/140; 128/861; 128/862

(58) Field of Classification Search ..... 482/11; 433/140; 128/861, 862
See application file for complete search history.

(56) References Cited

U.S. PATENT DOCUMENTS

| | | | | | |
|---|---|---|---|---|---|
| 1,586,499 | A | | 5/1924 | Worth | |
| 3,805,771 | A | * | 4/1974 | Wright | 601/23 |
| 4,044,762 | A | * | 8/1977 | Jacobs | 128/861 |
| 4,776,792 | A | | 10/1988 | Wagner et al. | |
| 4,791,941 | A | * | 12/1988 | Schaefer | 128/861 |
| 4,986,751 | A | * | 1/1991 | Bergersen | 433/6 |
| 5,044,950 | A | | 9/1991 | Hobish et al. | |
| 5,085,584 | A | | 2/1992 | Boyd | |
| 5,431,610 | A | * | 7/1995 | Miller | 482/11 |
| 5,467,783 | A | | 11/1995 | Meade | |
| 5,467,785 | A | | 11/1995 | McCarty, Jr. | |
| 5,513,656 | A | | 5/1996 | Boyd, Sr. | |
| 5,846,212 | A | | 12/1998 | Beeuwkes, III et al. | |
| 5,899,691 | A | | 5/1999 | Parker et al. | |
| 6,092,523 | A | | 7/2000 | Belfer | |
| 6,132,208 | A | * | 10/2000 | Mathieu | 433/6 |
| 6,458,149 | B1 | | 10/2002 | Peters-Combs | |
| 6,514,176 | B1 | | 2/2003 | Norton | |
| 7,083,548 | B1 | | 8/2006 | Moore et al. | |
| 7,153,237 | B2 | | 12/2006 | Norton | |
| 7,156,774 | B2 | | 1/2007 | Mohindra | |

* cited by examiner

*Primary Examiner* — Jerome W Donnelly
(74) *Attorney, Agent, or Firm* — McDonald Hopkins LLC; Kenneth D. Labudda

(57) ABSTRACT

A jaw relaxation exercise appliance and method of use to relieve the symptoms of the temporal mandibular joint (TMJ), such as limited opening and jaw pain, that is inexpensive and easy to use. The appliance may be form fit to each user and is designed to be a partial coverage appliance with a bottom guide plane for ease of movement to achieve optimal jaw position. It is also intended to be utilized in conjunction with an exercise. The appliance should be used for short intervals during the day. Patients are directed to slowly move or slide their lower jaw forward and then slowly slide the lower jaw rearward along the plane to a point of comfort.

21 Claims, 4 Drawing Sheets

JAW RELAXATION EXERCISE APPLIANCE

CROSS-REFERENCE TO RELATED APPLICATIONS

This application claims priority from U.S. Provisional Patent Application No. 60/933,729 entitled "JAW RELAXATION EXERCISE APPLIANCE" filed on Jun. 8, 2007, which is hereby incorporated by reference in its entirety.

FIELD OF THE INVENTION

The present invention is generally related to a dental appliance and, more particularly, to a dental application used as a therapeutic jaw exercise, a strengthener device or a corrective device.

BACKGROUND OF THE INVENTION

The temporomandibular joint is formed between the temporal bone of the skull and the mandible, and is commonly known as the "TMJ". The human body actually has two temporomandibular joints, one located on each side of the jaw in front of each ear.

The TMJ moves every time a person chews, talks, or even swallows.

The temporomandibular joint is a complex joint that must function in a coordinated way. Situated just in front of the ear, it consists of a condyle at the upper end of the mandible that fits into the condylar fossa on the lower part of the temporal bone of the skull. Each TMJ has an articulator disc of primarily cartilage material located between the condyle area and the temporal bone. The mandible, the large heavy bone of the lower jaw, is shaped rather like a horseshoe and pivots about the articulating disc in a gliding, hinge like motion. The disc moves within the joint during opening and closure of the jaw and, when displaced, strains the jaw muscles and causes muscle pain or fatigue around the jaw. In addition, disc displacement often causes a painful clicking in the TMJ during certain jaw movements as the disc moves between normal and displaced positions. Typical symptoms of temporal mandibular dysfunction (TMD) include cracking or popping sounds from the joint, chronic headaches, and limited movement of the jaw.

In TMD the muscles used for chewing and the joints of the jaw fail to work in conjunction. Due to emotional stress, some people clench their teeth so hard that they jolt their jaw out of its natural position, resulting in TMD. The misalignment of the TMJ causes muscle spasms, resulting in pain in front of the ear and in the head. The pain may also spread to the neck, shoulders and back. A number of problems may occur as a result of a temporomandibular joint disorder including headaches, jaw clenching, and bruxism (i.e., side-to-side grinding of teeth). A number of other problems may occur as a result of a strained disc, including TMJ lock, shoulder, neck, and back pain, and headaches.

The temporomandibular joint is susceptible to a variety of problems, some of which may be corrected by exercise therapy, and others which may require surgical techniques. The latter course of treatment gives rise to the need for post-surgical manipulation in order to preserve or enhance operation of the joint. In the past, therapeutic treatment of the temporomandibular joint by flexing the joint has been primarily provided by manual flexure of the joint performed by a nurse, physical therapist, or by exercise done by the patient.

There presently exist quite a few forms of treatment and several appliances used for the elimination of TMJ symptoms. A popular remedy is the insertion of a bite plate made of acrylic. It is worn either at night or 24 hours a day, from three to six months.

When worn during the day, it may be unsightly. Some others include full coverage maxillary night guards, Gelb appliances, and NTI devices.

Unfortunately, conventional methods of treating temporomandibular joint disorders can be costly, physically cumbersome, or involve invasive and irreversible treatment. Some of the more aggressive treatments of TMJ discomfort include orthodontic treatment, occlusal equibration, full mouth restoration of the dentition such as grinding down of teeth and various types of surgery. Orthodontic treatments and radical full mouth restorations merely indirectly address TMJ pain by adjusting the dental articulation and overall bite of the patient. Furthermore, orthodontic and restorative approaches are invasive, irreversible, and expensive.

Therefore, there is a need in the art to provide an appliance to relieve the symptoms of TMJ that is inexpensive, easy to use, only needs to be used for short intervals during the day, and is noninvasive. The present invention fulfills this need.

SUMMARY OF THE INVENTION

A jaw relaxation exercise appliance and method of use to relieve the symptoms of the temporal mandibular joint (TMJ), such as limited opening and jaw pain, that is inexpensive and easy to use. The appliance may be made of a thermoplastic material in order to provide a custom fit to each individual. The appliance fits over the users incisors. The appliance may include a handle. The appliance is designed to be a partial coverage appliance with a bottom guide plane for ease of movement to achieve optimal jaw position.

The general purpose of the present invention is to provide a jaw appliance to be used in conjunction with an exercise. The appliance should be used for short intervals during the day. Patients are directed to slowly move or slide their lower jaw forward and then slowly slide the lower jaw rearward along the plane to a point of comfort.

DESCRIPTION OF THE DRAWINGS

Operation of the invention may be better understood by reference to the following detailed description taken in connection with the following illustrations, wherein.

DETAILED DESCRIPTION

While the invention is described herein with reference to several embodiments, it should be clear that the invention should not be limited only to the embodiments disclosed or discussed. The description of the embodiments herein is illustrative of the invention and should not limit the scope of the invention as described or claimed.

As generally described herein, the present invention provides a Jaw Relaxation and Exercise (JRE) appliance 10. The JRE device 10 is a partial coverage appliance that may be designed to fit over the maxillary or mandibular arch. FIGS. 1-4 illustrate an embodiment of the invention. The appliance 10 is preferably made out of an acrylic and thermoplastic material, but may be made of any other appropriate material. The appliance 10 is also preferably made as a solid one-piece construction, but may also be made of any other appropriate construction.

Figure 3:
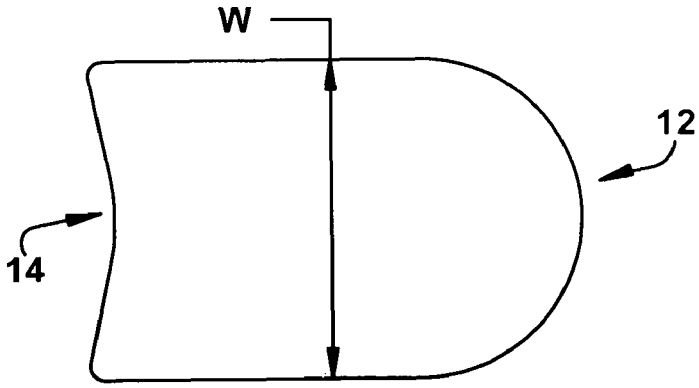
FIG. 3 is a top view of the jaw relaxation exercise appliance of FIG. 1.
Figure 7:
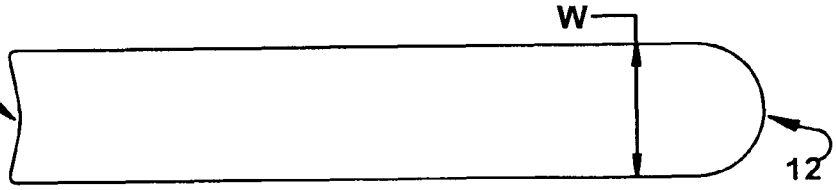
FIG. 7 is a top view of the alternate embodiment of the jaw relaxation exercise appliance of FIG. 5.

With further reference to FIGS. 1-4, the appliance 10 may include a first end 12, a second end 14, an upper portion 16 and a lower portion 18. The upper portion 16 may include a lip 30, a recess 40, and a plateau 50. The plane 20 is located on the lower portion 18 and preferably extends along the entire length of the lower portion 18. The lip 30 extends radially from the upper portion 16 and is preferably located near the first end 12, but may also be located at the first end 12. The lip 30 is also capable of being formed along a front surface of the user's incisors and the inside of the user's lip. The plateau 50 is preferably located at the second end 14 of the upper portion 16 and is capable of being formed along a back surface of the user's incisors and an inner surface of the user's mouth. The recess 40 is located between the lip 30 and plateau 50 in the upper portion 16 of the device 10. The recess 40 may receive the users teeth, preferably the users incisors, when the appliance 10 is in use. The recess 40 may receive either the user's upper or lower incisors, depending upon the condition the user's jaw is in. With reference to FIGS. 3 and 7, it is also preferable that the overall width W of the device be less than one inch.

Figure 1:
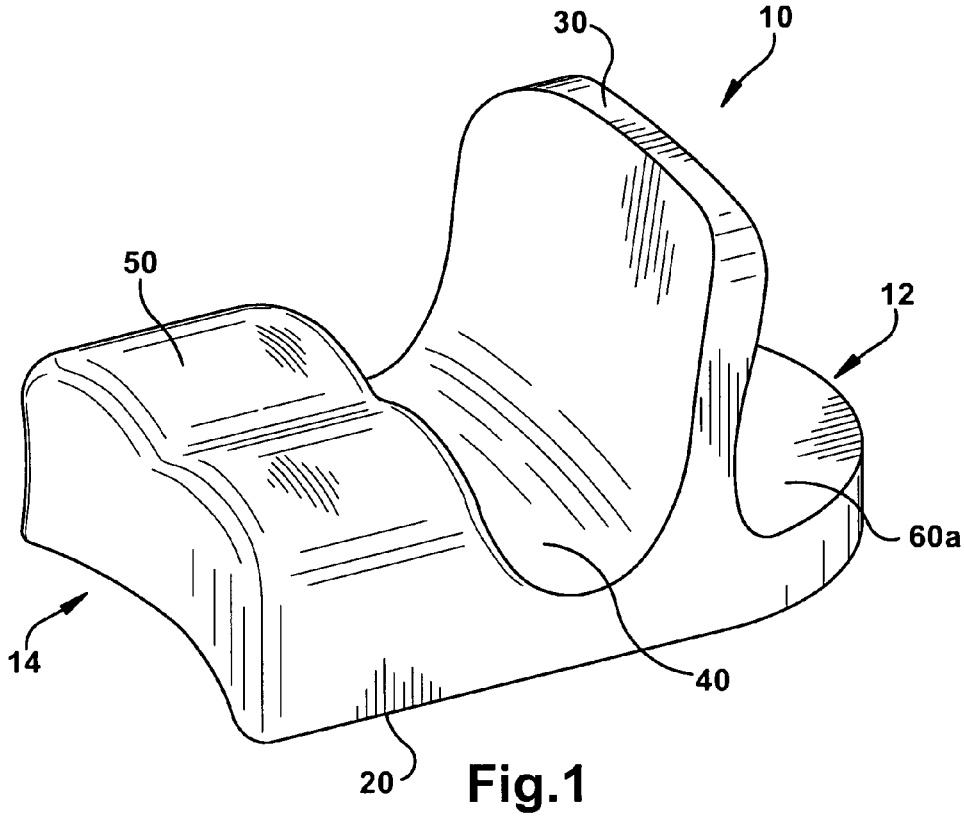
FIG. 1 illustrates a perspective view of a jaw relaxation exercise appliance in accordance with the present invention.
Figure 2:
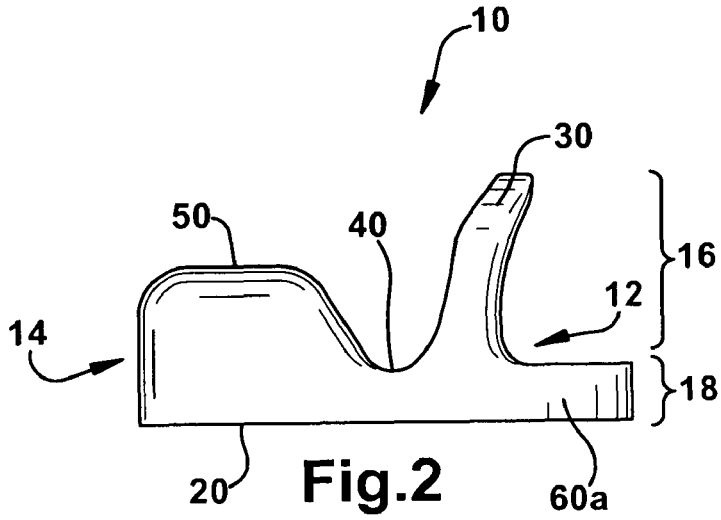
FIG. 2 is a front view of the jaw relaxation exercise appliance of FIG. 1.
Figure 4:
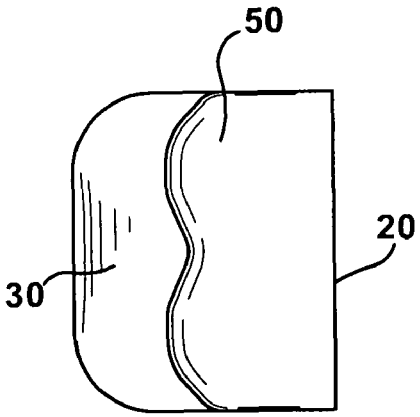
FIG. 4 is a side view of the jaw relaxation exercise appliance of FIG. 1.
Figure 5:
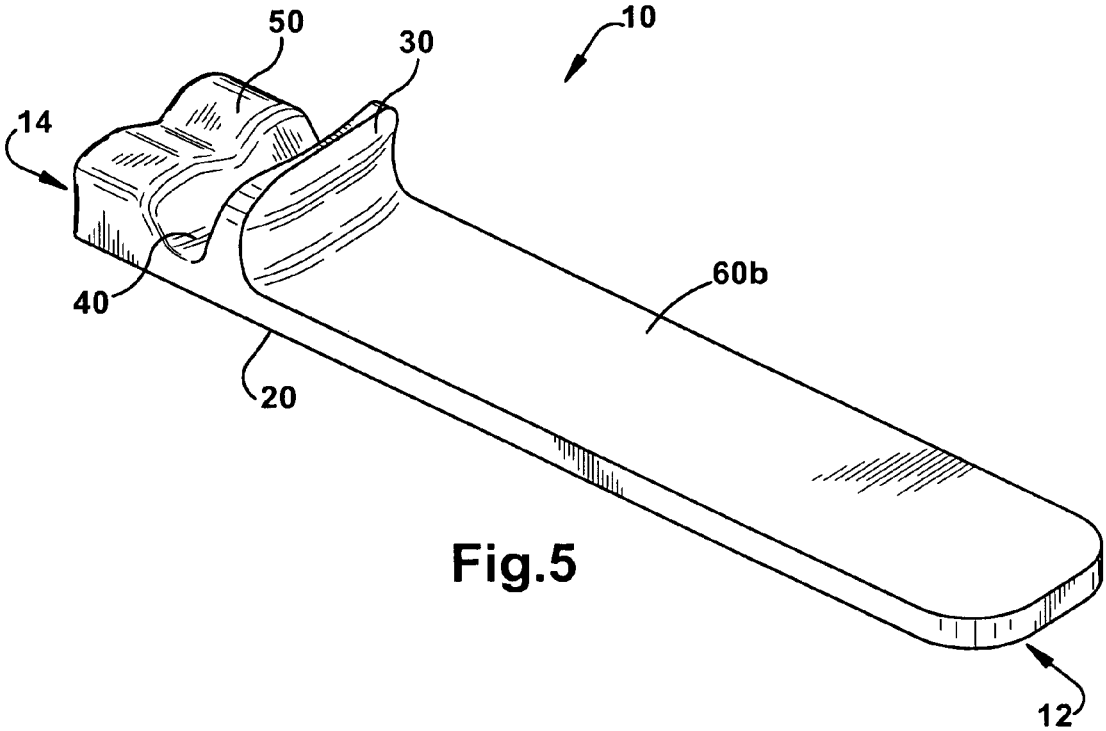
FIG. 5 illustrates a perspective view of an alternate embodiment of the jaw relaxation exercise appliance.
Figure 6:
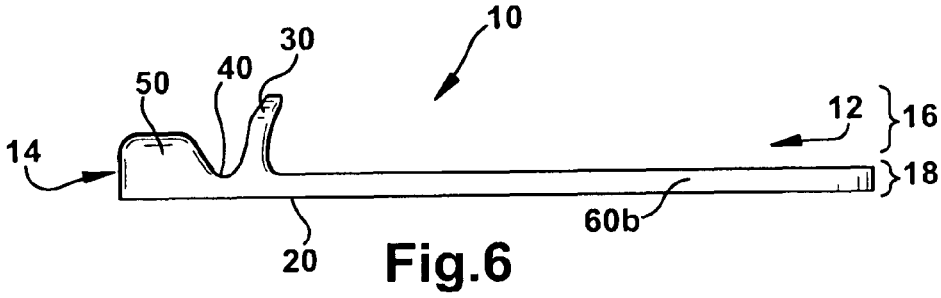
FIG. 6 is a front view of the alternate embodiment of the jaw relaxation exercise appliance of FIG. 5.
Figure 8:
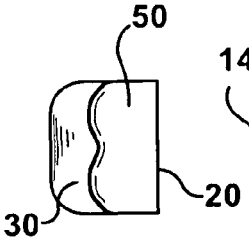
FIG. 8 is a side view of the alternate embodiment of the jaw relaxation exercise appliance of FIG. 5.

With reference to FIGS. 1 and 5, the device 10 may also include a handle portion 60 located at and extending from the first end 12. The handle portion 60 may be of a short length 60*a* or a long length 60*b*. The handle 60 may be used to aid in stabilizing the appliance 10 during placement in a user's mouth and while performing the exercise.

As discussed above, the appliance 10 may include a thermoplastic material located in the recess 40. The addition of a thermoplastic material aids in stabilizing the appliance 10 once it is in the correct position in the user's mouth. To cure the thermoplastic material, the appliance 10 may be placed in hot water to soften, then placed in the mouth and shaped around the teeth using finger and tongue pressure. Alternatively, the appliance 10 may be fitted at the dental office and then taken home to use. Once the appliance 10 is cured, it will provide a form fit to the individual user's incisors and mouth. After being fitted to the user's teeth and mouth, it can only be put back into that same correct position.

FIGS. 5-8 illustrate an alternate embodiment of the invention. In an alternative embodiment, the handle portion 60 comprises a long handle 60*b* that may an additional aid for the patient to use in stabilizing and placing the appliance 10 in the correct position, as well as aid the user in performing an exercise associated with the appliance 10. The longer handle 60*b* is also beneficial in treating some severe overjet cases and some Class III cases, as discussed below. To align the appliance 10, the user may line the bottom plane 20 of the appliance 10 up with the horizontal plane of the incisors and eyes and also the corner of the nose to the corner of the ear.

Preferably, the user may utilize the appliance 10 in conjunction with an exercise. Use of the appliance 10 with an exercise aids in releasing muscle tension by allowing the jaw to return to its most comfortable position relieving pain and tension resulting from any misalignment. Unlike other appliances currently available, the JRE appliance 10 is used only during the daytime for short intervals, and is not intended for nighttime use. In certain circumstances, some patients may also benefit from the use of full coverage maxillary night guards in addition to the JRE appliance 10.

In preparation of performing the exercise, the appliance 10 may be placed over the maxillary or mandibular front teeth, such as the incisors, but is preferably placed on the user's upper maxillary front teeth. The opposite maxillary or mandibular front teeth may be placed in contact with the linear bottom plane 20 of the appliance 10. As discussed above, the lip 30 and plateau 50 portions of the appliance 10 form fits to the upper front two to four incisors, depending on the user's individual mouth. The appliance 10 also provides a bottom flat plane 20 for the user's upper or lower incisors to slide back and forth on. Depending upon which set of teeth (i.e., the maxillary or mandibular front teeth) the appliance 10 is placed on, will determine whether the upper or lower incisors are slid along the plane 20. Thus, if the appliance 10 is placed on the user's upper maxillary incisors, the user's lower incisors will slide back and forth along the plane 20 during the exercise. Conversely, if the appliance 10 is placed on the user's lower mandibular incisors, the user's upper incisors will slide along the plane 20 as the user's lower jaw is extended forward and rearward during the exercise.

During performance of the exercise, the individual is instructed not to open their mouth or separate from the appliance 10 until finished with the exercise. After placing the appliance 10 in the mouth, patients are instructed to lightly place their incisors on to the plane 20. Patients are then directed to move or slide their lower jaw forward slowly, so as to slide their incisors substantially along the plane 20 from an original starting position to a point of comfort. The user is then directed to slide the lower jaw rearward along the plane 20 slowly to a point of comfort, such as the original position, for example. Then the user should repeat the exerciser for a certain period of time, such as approximately ten times. The user should spend about two seconds at each location during each exercise. Preferably, the exercise is repeated approximately four times with a ten second-rest period between intervals. The patient should always rest the lower jaw in the posterior position.

After completion of the exercise, the appliance 10 may be removed. The patient is instructed to perform the exercise approximately five times a day for several days, until their symptoms subside. By doing the exercise, it allows the muscles of the jaw to relax and thereby return to their optimal position.

The JRE appliance 10 is designed to be a partial coverage appliance with a bottom guide plane 20 for ease of movement to achieve optimal jaw position. It is also intended to be utilized in conjunction with an exercise, while other appliances on the market are not. The appliance 10 may also be used for patients with Class I, II, or III arches, while other types of devices may not be able to accommodate all of these arch types.

In Class I arches, the molar relationship of the occlusion is normal, but the other teeth may have problems like spacing, crowding, over or under eruption, etc. In Class II arches, the upper molars are placed not in the mesiobuccal groove but anteriorly to it.

Usually in the mesiobuccal cusp rests in between the first mandibular molars and second premolars. In Class III arches, the lower front teeth are more prominent than the upper front teeth. In this case, the patient may very often have a large mandible or a short maxillary bone.

When used with Class III arches, those with severe bite problems, the lower jaw typically projects farther forward than the upper jaw. Thus, in these situations the appliance 10 may be used in the opposite manner. In other words, the appliance 10 may be form fitted to the bottom incisors. In this case, however, the user will still slide his or her lower jaw out to a forward position and then backwards to its original position, as explained above.

For the dental community, the appliance 10 may be used for the treatment of patients with temporomandibular (TMJ) symptoms, such as limited opening and jaw pain. For the medical community, the appliance 10 may be used for headache relief such as migraines and tension headaches. This appliance 10 may also be used by anesthesiologist preoperatively for patients with limited opening to make intubations easier. Post operatively, the appliance 10 may be used with patients to eliminate jaw pain resulting from prolonged opening during a procedure. The appliance 10 may also be used with accident victims, to help determine cervical injury (e.g., whip lash) versus TMJ problems.

The embodiments of the invention have been described above and, obviously, modifications and alternations will occur to others upon reading and understanding this specification. The claims as follows are intended to include all modifications and alterations insofar as they come within the scope of the claims or the equivalent thereof.

Having thus described the invention, I claim:

1. A jaw appliance for performing a jaw exercise, the appliance comprising:

a body comprising an upper portion, a lower portion, a first end and a second end;

a lip located near said first end extending radially from said upper portion and formed along a front surface of a user's incisors;

a plateau located at said second end of said upper portion and capable of being formed along a back surface of the user's incisors;

a recess located in said upper portion between said lip and said plateau, wherein the recess is limited to receiving the user's incisors; and an entirely flat plane located on said lower portion whereby the user is capable of performing an exercise by forwardly extending the lower jaw whereby the opposite incisors slide substantially along said plane and then retracting the lower jaw to slide the lower jaw rearwardly along the plane.

2. The appliance of claim 1 further comprising a handle located at said first end.

3. The appliance of claim 2, wherein said handle is capable of stabilizing the appliance during placement in a user's mouth and while performing the exercise.

4. The appliance of claim 1, wherein said recess is made of a thermoplastic material.

5. The appliance of claim 1, wherein the appliance is a one-piece construction.

6. The appliance of claim 1, wherein said lip is further capable of being formed along an inside of the user's lip.

7. The appliance of claim 1, wherein said plateau is further capable of being formed along an inner surface of a user's mouth.

8. The appliance of claim 1, wherein the incisors are the upper incisors and the opposite incisors are the lower incisors.

9. The appliance of claim 1, wherein the incisors are the lower incisors and the opposite incisors are the upper incisors.

10. A method of performing a jaw relaxation exercise using a jaw appliance, the method comprising the steps of:

providing a jaw appliance comprising:

a body comprising an upper portion, a lower portion, a first end and a second end;

a lip located near said first end extending radially from said upper portion;

a plateau located at said second end of said upper portion;

a recess located in said upper portion between said lip and said plateau, said recess being adapted for receiving only the incisors;

an entirely flat plane located on said lower portion where the user performs the exercise;

form fitting a user's incisors into said recess;

lightly placing the opposite incisors onto said plane and maintaining the user's mouth in a substantially closed position;

sliding the lower jaw forward so as to slide the incisors substantially along said plane;

sliding the lower jaw rearwardly along said plane; and repeating said jaw relaxation exercise for a certain period of time.

11. The method of claim 10, wherein the incisors are the upper incisors and the opposite incisors are the lower incisors.

12. The method of claim 10, wherein the incisors are the lower incisors and the opposite incisors are the upper incisors.

13. The method of claim 10 further comprising the step of form fitting said appliance to the user's mouth and incisors.

14. The method of claim 13, wherein said lip is capable of being formed along a front surface of a user's incisors.

15. The method of claim 13, wherein said plateau is capable of being formed along a back surface of the user's incisors.

16. The method of claim 10, wherein said jaw appliance further comprises a handle located at said first end.

17. The method of claim 16, further comprising the step of using said handle to aid in stabilizing the appliance during the initial placement in the user's mouth and while performing the exercise.

18. The method of claim 10, wherein the lower jaw is slid forward along said plane from an original starting position to a point of comfort.

19. The method of claim 18, wherein the lower jaw is slid rearward along said plane to a point of comfort such as the original starting position.

20. The method of claim 10, wherein the user maintains the lower jaw in the forward position and the rearward position for approximately two seconds in each position.

21. The method of claim 10, wherein said certain period of time includes performing the exercise for approximately ten repetitions.

* * * * *